US011660607B2

(12) United States Patent
Hilding et al.

(10) Patent No.: US 11,660,607 B2
(45) Date of Patent: May 30, 2023

(54) SEPARATION DISC FOR A CENTRIFUGAL SEPARATOR

(71) Applicant: ALFA LAVAL CORPORATE AB, Lund (SE)

(72) Inventors: Klas Hilding, Älta (SE); Sven-Åke Nilsson, Gnesta (SE); Peter Thorwid, Sundbyberg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 813 days.

(21) Appl. No.: 16/607,991

(22) PCT Filed: Apr. 30, 2018

(86) PCT No.: PCT/EP2018/061012
§ 371 (c)(1),
(2) Date: Oct. 24, 2019

(87) PCT Pub. No.: WO2018/202611
PCT Pub. Date: Nov. 8, 2018

(65) Prior Publication Data

US 2021/0107014 A1 Apr. 15, 2021

(30) Foreign Application Priority Data

May 2, 2017 (EP) ..... 17168960

(51) Int. Cl.
*B04B 1/08* (2006.01)
*B04B 7/14* (2006.01)

(52) U.S. Cl.
CPC ..... *B04B 1/08* (2013.01); *B04B 7/14* (2013.01)

(58) Field of Classification Search
CPC ..... B04B 1/08; B04B 7/14
(Continued)

(56) References Cited

U.S. PATENT DOCUMENTS

| | | | | |
|---|---|---|---|---|
| 809,685 | A | 1/1906 | Hellström | |
| 4,036,429 | A | 7/1977 | Ivin et al. | |
| 4,262,841 | A * | 4/1981 | Berber | B04B 7/14 494/73 |
| 4,861,329 | A | 8/1989 | Borgström et al. | |
| 8,454,487 | B2 | 6/2013 | Lindroth et al. | |
| 2014/0148327 | A1 * | 5/2014 | Nilsson | B04B 1/08 72/208 |

(Continued)

FOREIGN PATENT DOCUMENTS

| | | | |
|---|---|---|---|
| AT | 374 120 | 3/1984 | |
| AT | 374120 B * | 3/1984 | B04B 7/14 |

(Continued)

OTHER PUBLICATIONS

AT 374120 EPO Machine Translation.*

(Continued)

*Primary Examiner* — Shuyi S. Liu
(74) *Attorney, Agent, or Firm* — Birch, Stewart, Kolasch & Birch, LLP

(57) ABSTRACT

A separation disc for a centrifugal separator is adapted to be included in a stack of separation discs inside a centrifugal rotor for separating a fluid mixture. The separation disc has a truncated conical shape with an inner surface and an outer surface and a plurality of spacing members extending from at least one of the inner surface and the outer surface. The spot-formed spacing members are for providing interspaces between mutually adjacent separation discs in a stack of separation discs. The separation disc further includes at least one elongated rib extending from the inner surface to a height (h) that is less than the height (H) to which the plurality of spacing members extend. Further, at least one elongated rib extends from first position on the inner surface to a second position on the inner surface. The second position is at a radial distance that is larger than the radial
(Continued)

distance of the first position, and the relation between the height of the elongated ribs (h) and the spacing members (H) are h/H>0.7.

20 Claims, 6 Drawing Sheets

(58) Field of Classification Search
USPC ..... 494/67, 68, 69, 70, 72, 73
See application file for complete search history.

(56) References Cited

U.S. PATENT DOCUMENTS

| | | | | |
|---|---|---|---|---|
| 2014/0221187 | A1* | 8/2014 | Konig | B04B 1/08 494/70 |
| 2015/0045199 | A1* | 2/2015 | Thorwid | B04B 1/14 494/37 |
| 2016/0001302 | A1 | 1/2016 | Quiter et al. | |
| 2016/0303579 | A1 | 10/2016 | Nilsson | |

FOREIGN PATENT DOCUMENTS

| | | | | |
|---|---|---|---|---|
| CN | 103702763 | A | 4/2014 | |
| CN | 105813772 | A | 7/2016 | |
| DE | 557376 | | 8/1932 | |
| DE | 195 37 268 | C1 | 2/1997 | |
| DE | 197 05 704 | C1 | 7/1998 | |
| EP | 2 556 895 | A1 | 2/2013 | |
| GB | 1 330 097 | | 9/1973 | |
| GB | 1 486 861 | | 9/1977 | |
| GB | 1486861 | A * | 9/1977 | B04B 1/08 |
| WO | WO 2013/020978 | A1 | 2/2013 | |

OTHER PUBLICATIONS

International Search Report, issued in PCT/EP2018/061012, dated Jul. 23, 2018.
Written Opinion of the International Searching Authority, issued in PCT/EP2018/061012, dated Jul. 23, 2018.
Chinese Office Action and Search Report for Chinese Application No. 201880029337.1, dated Dec. 3, 2020, with English translation.

* cited by examiner

SEPARATION DISC FOR A CENTRIFUGAL SEPARATOR

FIELD OF THE INVENTION

The present invention relates to the field of centrifugal separation, and more specifically to centrifugal separators comprising separation discs.

BACKGROUND OF THE INVENTION

Centrifugal separators are generally used for separation of liquids and/or solids from a liquid mixture or a gas mixture. During operation, fluid mixture that is about to be separated is introduced into a rotating bowl and due to the centrifugal forces, heavy particles or denser liquid, such as water, accumulates at the periphery of the rotating bowl whereas less dense liquid accumulates closer to the central axis of rotation. This allows for collection of the separated fractions, e.g. by means of different outlets arranged at the periphery and close to the rotational axis, respectively.

Separation discs are stacked in the rotating bowl at a mutual distance to form interspaces between themselves, thus forming surface-enlarging inserts within the bowl. Separation discs of metal are used in connection with relatively robust and large-sized centrifugal separators for separating liquid mixtures and the separation discs themselves are thus of relatively large size and are exposed to both high centrifugal and liquid forces. The liquid mixture to be separated in the centrifugal rotor is conducted through the interspaces, wherein the liquid mixture is separated into phases of different densities during operation of the centrifugal separator. The interspaces are provided by spacing members arranged on the surface of each separation disc. There are many ways of forming such spacing members. They may be formed by attaching separate members in the form of narrow strips or small circles of sheet metal to the separation disc, usually by spot welding them to the surface of the separation disc.

In order to maximize the separating capacity of the centrifugal separator, there is a desire to fit as many separation discs as possible into the stack within a given height in the separator. More separation discs in the stack means more interspaces in which the liquid mixture can be separated. However, as the separation discs are made thinner, they will exhibit a loss in rigidity and irregularities in their shape may begin to appear. The separation discs are furthermore compressed in the stack inside the centrifugal rotor to form a tight unit. Thin separation discs may thereby flex and/or because of their irregular shaping give rise to unevenly sized interspaces in the stack of separation discs. Accordingly, in certain parts of the interspaces (e.g. far away from a spacing member), the mutually adjacent separation discs may be completely compressed against each other to leave no interspaces at all. In other parts of the interspaces (e.g. in the vicinity of a spacing member) the separation discs will not flex much and accordingly provide an adequate height.

A disc comprising spot-shaped spacing members for decreasing the risk of unevenly sized interspaces in the stack is disclosed in WO2013020978. The disc in this disclosure comprises spot-shaped spacing members having spherical or cylindrical shape as seen in the direction of their height.

Further, the flow of the phases in the interspaces between the discs is of great importance. Thus, there is a need in the art for alternative designs for separation discs that facilitate the use of thin discs that at the same time provides a good flow of the phases between the discs during separation.

SUMMARY OF THE INVENTION

A main object is to provide a separation disc that aids in guiding separated sludge along the surface of the disc during operation.

A further object of the present invention is to provide a separation disc for a centrifugal separator that decreases the risk of unevenly sized interspaces in a stack.

A further object is to provide a disc that allows for the use of thin separation discs in a disc stack.

An object is also to provide a disc stack and a centrifugal separator comprising such separation discs.

As a first aspect of the invention there is provided a separation disc for a centrifugal separator, the disc being adapted to be comprised in a stack of separation discs inside a centrifugal rotor for separating a fluid mixture, wherein the separation disc has a truncated conical shape with an inner surface and an outer surface and a plurality of spacing members extending a height (H) from at least one of the inner surface and the outer surface, wherein the plurality of spacing members are for providing interspaces between mutually adjacent separation discs in a stack of separation discs, and wherein the separation disc further comprises at least one elongated rib extending from the inner surface to a height (h) that is less than the height (H) to which the plurality of spacing members extend, and wherein the at least one elongated rib extends from a first position on the inner surface to a second position on the inner surface, wherein the second position is at a radial distance that is larger than the radial distance of the first position, and wherein the relation between the height of the elongated ribs (h) and the spacing members (H) is $h/H>0.7$.

The separation disc may e.g. comprise a metal or be of metal material, such as stainless steel.

The separation disc may further comprise a plastic material or be of a plastic material.

The separation disc may be injection molded.

The separation disc may further also be adapted to be compressed in a stack of separation discs inside a centrifugal rotor for separating a liquid mixture.

A truncated conical shape refers to a shape that is frustoconical, i.e. having the shape of a frustum of a cone, which is the shape of a cone with the narrow end, or tip, removed. The axis of the truncated conical shape thus defines the axial direction of the separation disc, which is the direction of the height of the corresponding conical shape or the direction of the axis passing through the apex of the corresponding conical shape.

The inner surface is thus the surface facing the axis whereas the outer surface is the surface facing away from the axis of the truncated cone. The spacing-members may be provided only on the inner surface, only at the outer surface or on both the inner and outer surface of the truncated conical shape.

Half of the opening angle of the frustoconical shape is usually defined as the "alpha angle". As an example the separation disc may have an alpha angle between 25° and 45°, such as between 35° and 40°.

A spacing member is a member on the surface of a disc that spaces two separation discs apart when they are stacked on top of each other, i.e. defining the interspace between the discs. The spacing members may be arranged on the disc so that they support both the radial outer portion of the disc and the radial inner portion of the disc. In other words, the spacing members may be distributed both on the radially outer half of surface of the disc and on the radially inner half of the surface of the disc.

The height H of the spacing members is the height perpendicular to the surface.

The spacing members may extend to a height H that is less than 0.8 mm from the surface of the separation disc. As an example, the spacing members may extend to a height that is less than 0.60, such as less than 0.50 mm, such as less than 0.40 mm, such as less than 0.30 mm, such as less than 0.25 mm, such as less than 0.20 mm, from the surface of the separation disc.

The separation disc further comprises at least one elongated rib that extends on the inner surface a height h that is less than height H of the spacing members.

Thus, the elongated ribs are of such height that they do not form part of any spacing member and they do not bear any weight in a disc stack of separation discs, but are instead provided for guiding means.

The elongated rib has thus a length that is larger than its width. The length may be in a radial direction. An elongated rib may extend a distance (d) on the surface that is more than the height (h) above the surface, such has more than twice the height such as more than five times the height, such as more than ten times the height.

The elongated ribs or strips have a length that is above 10 mm, such above 20 mm, such as above 50 mm, such as above 100 mm.

Further, the elongated ribs extend radially outward, i.e. from a first to a second position, wherein the second position is radially outside the first position. Thus, the separation disc may comprise a central opening and an outer perimeter, and the elongated rib may extend in a direction from the central opening towards the outer perimeter.

The relation of h/H is at least 0.7, meaning that the height of the elongated ribs is at least 70% of the height of the spacing members. Thus, the elongated ribs may be of such height that they during operation of a centrifugal separator comprising a stack of such separation discs extend out into the geostrophic flow between two adjacent separation discs, i.e. extend out from any formed Ekman layers at the surface of the separation disc.

In embodiments of the first aspect of the invention, the relation between the height of the elongated ribs (h) and the height of the spacing members (H) is $h/H \geq 0.7$. In embodiments of the first aspect of the invention, the relation between the height of the elongated ribs (h) and the height of the spacing members (H) may be $0.75 \leq h/H \leq 0.95$, such as $0.80 \leq h/H \leq 0.90$.

The thickness of the separation disc may be less than 0.60 mm, such as less than 0.50 mm, such as less than 0.45 mm, such as less than 0.40 mm, such as less than 0.35 mm, such as less than 0.30 mm.

Furthermore, the separation disc may have a diameter that is more than 200 mm, such as more than 300 mm, such as more than 350 mm, such as more than 400 mm, such as more than 450 mm, such as more than 500 mm, such as more than 530 mm.

The first aspect of the invention is based on the insight that the elongated strips do not have to bear any load in a compressed stack but may instead function solely as guiding means. For example, in a compressed stack of separation discs, the separation is performed in the interspace between two adjacent discs. The heavier phase, such as sludge, is transported along the surface of the upper disc, i.e. along the "roof" of the interspace, whereas a separated less dense phase is transported along the surface of the lower disc, i.e. along the "floor" of the interspace. Thus, with elongated strips having a lower height that the spacing members and arranged on the inner surface of the disc, these elongated strips will aid in guiding sludge along the "roof" of the interspace but will not interfere with the phase transported along the "floor" of the interspace.

In embodiments of the first aspect of the invention, also the spacing members extend from the inner surface.

Thus, both the spacing members and the elongated ribs may extend from the inner surface, such as solely from the inner surface.

In embodiments of the first aspect of the invention, the separation disc comprises at least four elongated ribs.

As an example, the separation disc may comprise at least 8, such as at least 12, such as at least 18 elongated ribs.

Furthermore, the separation disc may comprise 4-60 elongated ribs, such as 4-50, such as 8-40, such as 12-30, elongated ribs on the inner surface.

The elongated ribs may be equally spaced throughout the circumference of the separation disc.

In embodiments of the first aspect of the invention, the at least one elongated rib is straight and has an extension in the radial direction.

The radial direction is thus from the axis of rotation (x) radially toward an outer perimeter of the disc, such as from a central opening towards the outer perimeter of the separation disc. The at least one elongated rib may extend in a straight radial direction or in a straight direction that forms an angle with the radius of the separation disc. A straight elongated rib may thus be arranged to guide a phase along a straight path on the surface of the separation disc. The elongated ribs may have an extension that is predominantly in the radial direction.

In embodiments of the first aspect of the invention, the at least one elongated rib is curved. The extension of the curved ribs may be predominantly in the radial direction.

Thus, at least one elongated rib may be curved. A curved elongated rib may be curved when viewed as a projection onto a plane that is perpendicular to the axis of rotation (X).

Thus, the ribs may extend in curved paths and form at least at the radially outer surrounding portions of the separation disc an angle with the generatrices of the separation disc. As a consequence of the curved form of the elongated ribs also a separated phase may be guided by the elongated ribs along paths which are curved in a corresponding way.

The radial length of the elongated ribs may vary on a disc or all elongated ribs may have the same length. The radial length may for example be more than 10%, such as more than 25% of the radial length of the disc, i.e. the length between central opening and the outer perimeter.

In embodiments of the first aspect of the invention, the at least one elongated rib extend a length that is more than 50% of the radial extension of the inner surface of the disc.

For example, the at least one elongated rib extend a length that is more than 75% of the radial extension of the inner surface of the disc.

The at least one elongated rib may extend radially along substantially the whole radial extension of the inner surface of the disc, meaning that the ribs may extend across substantially the whole of the conical portion of the separation disc and end up in the vicinity of the radially outer surrounding edge of the separation disc.

In embodiments of the first aspect of the invention, the at least one elongated rib has a width at the surface of the separation disc that is below 2 mm.

Thus, the width of at least one elongated rib may be below 1.5 mm, such as below 1 mm.

The elongated ribs may be in the form of separate pieces of narrow strips or circular blanks of sheet metal, which are attached to the surface of the separation disc. As an alternative or complement, elongated ribs may also be integrally formed with the material of the separation disc.

In embodiments of the first aspect of the invention, the spacing members and the at least one elongated rib are integrally formed in one piece with the material of the separation disc. For example, the spacing members and the elongated ribs may be integrally formed on the inner surface of the disc.

Thus, all elevations of the separation disc may be formed by the material of the separation disc itself In embodiments of the first aspect of the invention, the at least one elongated rib is wider at the surface than at the portion at the height (h) to which the elongated rib extends, as seen in a cross-section that is perpendicular to the direction in which the elongated rib extends on the surface.

Thus, the elongated rib may form a ridge at the surface that has a tapering cross-section from the surface and out. The cross-section may be tip-shaped. As an example, the tip-shaped cross-section may have a geometric shape that tapers smoothly from the flat base at the surface to a tip, i.e. to an apex a certain height above the base. The apex may be directly above the centroid of the base. However, the apex may also be located at a point that is not above the centroid so that the tip-shaped spacing members have the form of an oblique cone or an oblique pyramid. The "tip" of the tip-shaped cross-section may have a tip radius which is less than the height h. The tip may thus be rounded.

Further, the portion at the height (h) to which the elongated rib extends may be flat, i.e. more or less parallel to the surface.

It may be advantageous for the flow dynamics between the separation discs to have an elongated rib that is wider at the surface and then becomes thinner as it extends from the surface. In other words, an elongated rib having such a shape may to a lesser degree obscure the flow of a fluid between the separation discs if compared to an elongated rib that has a substantially constant cross-section.

In embodiments of the first aspect of the invention, the plurality of spacing members comprise a plurality of spot-formed spacing members.

It may be advantageous to combine the elongated ribs with spot-formed spacing members since the spot-formed spacing members introduce little obstruction of flow while still bearing the load in a compressed stack as compared to traditional elongated spacing members. Thus, a combination of spot-formed spacing members and elongated strips that are lesser in height gives a very low obstruction of the flow between the discs while still being able to guide a separated heavy phase or particles along the surface of the separation disc.

A spot-formed spacing member may extend to a width which is less than 5 mm along the surface of the separation disc. The width of the base of the spot-formed spacing member may refer to or correspond to the diameter of the spot-formed spacing member at the surface. If the base at the surface has an irregular shape, the width of the spot-formed spacing member may correspond to the largest extension of the base at the surface.

As an example, the base of the spot-formed spacing member may extend to a width which is less than 2 mm along the surface of the separation disc, such as to a width which is less than 1.5 mm along the surface of the separation disc, such as to a width which is about or less than 1 mm along the surface of the disc.

Thus, due to a small size compared to the "conventional" large-sized spacing members in the form of e.g. elongated strips, the spacing members may be provided in greater number without blocking or significantly impeding the flow of fluid mixture between the discs in a stack of separation discs.

The spot-formed spacing members may have spherical or cylindrical shape as seen in the direction of their height.

As an example, the spot-formed spacing members have a tip-shaped cross-section.

Thus, the plurality of spot-formed spacing members may comprise spot-formed spacing members that are tip-shaped and taper from the base at the surface of the separation disc towards a tip extending a certain height from the surface.

The spot-formed spacing members may be tip-shaped at least in a cross-section of the spacing member and the cross-section, or the spacing member as a whole, thus tapers from the base at the surface towards a tip, which extends a certain height from the surface. The height of a tip-shaped spacing member is the height perpendicular to the surface.

The spot-formed spacing members may be tip-shaped in at least one cross-section, such as the cross-section perpendicular to the radius of the disc. Thus, the spot-formed spacing members may form small ridges that extend on the surface. The ridges may for example extend in a radial direction of the separation disc, i.e. substantially along a direction of flow of fluid mixture along the separation disc.

The spot-formed spacing members may be tip-shaped in more than one cross-section.

The spot-formed spacing members may be tip-shaped as a whole, i.e. each cross section of a spot-formed spacing member is tip-shaped. Thus, the spot-formed and tip-shaped spacing members may e.g. have the form of a cone, i.e. be cone-shaped, or the form of a pyramid, depending on the form of the base along the surface. The base at the surface may thus have the form as a cross, a circle, an ellipse, a square or have a rectangular shape.

As an example, the tip-shaped spacing members may have the form of a cone or a pyramid, i.e. have a geometric shape that tapers smoothly from the flat base at the surface to the tip, i.e. to an apex a certain height above the base. The apex may be directly above the centroid of the base. However, the apex may also be located at a point that is not above the centroid so that the tip-shaped spacing members have the form of an oblique cone or an oblique pyramid.

If spot-formed and tip-shaped spacing members are introduced on the surfaces of the thin metal separation discs, then equidistant spaces in a stack comprising thin separation discs may be achieved. Hence, the separating capacity of the centrifugal separator can in this way be further increased by fitting a greater number of the thinner metal separation discs into the stack. The invention will in this way facilitate the use of separation discs as thin as possible to maximize the number of separation discs and interspaces within a given stack height. Furthermore, the tip-shaped and spot-formed spacing member lead to less contact area between a spacing member of a disc and an adjacent disc, thus leading to a larger surface area of the discs in a stack being available for separation. Further, a small contact area decreases the risk of dirt or impurities being stuck within a disc stack during operation of a centrifugal separator, i.e. decreases the risk of contamination.

Also, the equidistant spaces in between the separation discs contribute to decreasing the risk of dirt or impurities being stuck within the disc stack during operation of the centrifugal separator. Moreover, the equidistant spaces provide for improved separation performance in the centrifugal separator. Since the interspaces formed between the separation discs are equidistant, the separation performance is substantially the same all over the separation area formed within the disc stack, and thus, closer to a theoretically calculated separation performance of the relevant centrifugal separator. Whereas in a prior art disc stack, wherein the separation discs are deformed during operation of the centrifugal separator and thus, form uneven interspaces between the discs, the separation performance varies within the disc stack, and therefore, is farther from the theoretically calculated separation performance of the relevant centrifugal separator.

As an example, spot-formed spacing members may extend from the surface of the separation disc in a direction that forms an angle with the surface which is less than 90 degrees. Both spot-formed spacing members having spherical or cylindrical shape as seen in the direction of their height and spot-formed spacing members being tip-shaped, may extend from the surface of the separation disc in a direction that forms an angle with the surface which is less than 90 degrees.

Furthermore, spot-formed spacing members may extend from the surface of the separation disc in substantially the axial direction of the truncated conical shape of the separation disc. Both spot-formed spacing members having spherical or cylindrical shape as seen in the direction of their height and spot-formed spacing members being tip-shaped, may extend from the surface of the separation disc in substantially the axial direction of the truncated conical shape of the separation disc.

Moreover, the tip of the spot-formed spacing members may have a tip radius which is less than the height to which the spot-formed spacing members extend from the surface.

As an example, the tip of the spot-formed spacing members may have a tip radius which is less than half the height, such as less than a quarter of the height, such as less than a tenth of the height, to which the spot-formed spacing members extend from the surface. With such a "sharp" tip, the spot-formed spacing member may more easily adhere to the surface of an adjacent disc in a disc stack, and a sharp tip also decreases blockage or obstruction of the flow of fluid mixture between the discs in a stack of separation discs.

The plurality of separation discs comprising spot-formed spacing members may comprise spacing members having different shape. Thus, a single disc may comprise spot-formed spacing members having different shapes, and the plurality of discs may comprise different discs having spot-formed spacing members of different shapes, i.e. some discs may have only spherical spot-formed spacing members whereas some discs may have only tip-shaped spot-formed spacing members.

However, the plurality of discs comprising spot-formed spacing members may also comprise separation discs having the same type of spot-formed spacing members.

In embodiments of the first aspect of the invention, a majority of the plurality of discs comprising spot-formed spacing members are of the same kind in terms of thickness, diameter, shape and number of spot-formed spacing members.

Further, a majority of the spot-formed spacing members may be distributed on the surface of the separation disc at a mutual distance which is less than 20 mm.

As an example, the spot-formed spacing members may be distributed on the surface of the separation disc at a mutual distance which is less than 15 mm, such as about or less than 10 mm.

The spot-formed-spacing members may be evenly distributed on the surface, distributed in clusters, or distributed on the surface at different mutual distance, e.g. to form areas of the disc in which the density of spot-formed spacing members is higher compared to the density of spot-formed spacing members on the rest of the same surface of the disc.

The inner or outer surface of the separation disc may have a surface density of the spot-formed spacing members that is above 10 spacing members/$dm^2$, such as above 25 spacing members/$dm^2$, such as above 50 spacing members/$dm^2$, such as above 75 spacing members/$dm^2$, such as about or above 100 spacing members/$dm^2$.

Further, the inner or outer surface of the separation disc may have a surface density of the spot-formed spacing members that is above 10 spacing members/$dm^2$, such as above 25 spacing members/$dm^2$, such as above 50 spacing members/$dm^2$, such as above 75 spacing members/$dm^2$, such as about or above 100 spacing members/$dm^2$, and the separation disc having a thickness that is less than 0.40 mm, such as less than 0.30 mm.

However, the whole inner or outer surface does not have to be covered with the spot-formed spacing members. Consequently, in embodiments of the first aspect of the invention, the inner or outer surface of the separation disc comprises at least one area of at least 1.0 $dm^2$ having a density of the spot-formed spacing members that is above 10 spacing members/$dm^2$, such as above 25 spacing members/$dm^2$, such as above 50 spacing members/$dm^2$, such as above 75 spacing members/$dm^2$, such as about or above 100 spacing members/$dm^2$.

In embodiments of the first aspect of the invention, the separation disc further comprises at least one through hole in the truncated surface or formed by at least one cut-out at the outer periphery of separation disc. Such through holes or cut-outs may form axial rising channels in a stack of separation discs that may facilitate feeding and distributing fluid mixture, such as a liquid, into the interspaces in the stack of separation discs.

As a second aspect of the invention, there is provided a stack of separation discs adapted to be comprised inside a centrifugal rotor for separating a liquid mixture, comprising axially aligned separation discs having a truncated conical shape with an inner surface and an outer surface, and wherein the axially aligned separation discs comprises a plurality of discs having spacing members and at least one elongated rib according to the first aspect above arranged so that the elongated rib on a separation disc is not in contact with an adjacent separation disc.

The terms and definitions used in relation to the second aspect are the same as discussed in relation to the first aspect above.

The stack of separation discs may be aligned on an aligning member, such as on a distributor. Thus, in embodiments of the second aspect of the invention, the stack further comprises a distributor onto which the separation discs are aligned to form a stack.

The stack of separation discs may be adapted to be compressed with a force that is above 8 tons.

In embodiments of the second aspect of the invention, the plurality or number of separation discs having spacing members and at least one elongated rib according to the first aspect above may be more than 50% of the total number of separation discs in the stack of separation discs, such as more than 75% of the total number of separation discs in the stack of separation discs, such as more than 90% of the total number of separation discs in the stack of separation discs. As an example, all discs of the disc stack may be discs having spacing members and at least one elongated rib according to the first aspect above.

In embodiments of the second aspect of the invention, the plurality of discs having spacing members and at least one elongated rib according to the first aspect above are arranged so that a majority of the spacing members of a disc are displaced compared to the spacing members of an adjacent disc. Further, also the elongated ribs of a separation disc may be displaced compared to the elongated ribs of an adjacent separation disc.

A spacing member or elongated rib being "displaced" compared to a spacing member or elongated rib on an adjacent disc refers to the discs being arranged so that the spacing member or elongated ribs are not at the same position as a spacing member or elongated rib on an adjacent disc. Thus, a spacing member being displaced does not abut an adjacent disc at a position where the adjacent disc has a spacing member.

Hence, the discs having spacing members and at least one elongated rib according to the first aspect above may be arranged so that the spacing members or elongated ribs of a disc are not axially aligned with a spacing member or elongated rib of an adjacent disc. Thus, the spacing members may be radially displaced in relation to the spacing members of adjacent discs as seen in an axial plane through the axis of rotation, and/or the spacing members may be circumferentially displaced in relation to the spacing members of adjacent discs as seen in a radial plane through the axis of rotation. Also, the elongated ribs may be radially displaced in relation to the elongated ribs of adjacent discs as seen in an axial plane through the axis of rotation, and/or the elongated ribs may be circumferentially displaced in relation to the elongated ribs of adjacent discs as seen in a radial plane through the axis of rotation.

Displacement of spacing members or elongated ribs may be achieved by a disc being turned in the circumferential direction compared to an adjacent disc, such as turned through a predetermined angle in a circumferential direction. Thus, some or each separation disc may be gradually turned through an angle in the circumferential direction as the separation discs are being stacked on top of each other to form the stack.

As an example, a spacing member of a disc may be displaced in relation to a corresponding spacing member of an adjacent disc a circumferential distance and/or a radial distance that is between 2-15 mm, such as between 3-10 mm, such as about 5 mm. Also the elongated ribs may be displaced a circumferential distance as described above.

As an example, a spacing member of a disc may be displaced in relation to a corresponding spacing member of an adjacent disc a circumferential distance that is about half of the mutual distance between spacing members of the disc. Also the elongated ribs may be displaced a circumferential distance as described above.

Furthermore, displacement of spacing members and/or elongated ribs may also be achieved by using separation discs having different patterns of spacing members and/or elongated ribs so that the spacing members of a disc are not axially aligned with the spacing members of an adjacent disc and/or the elongated ribs of a disc are not axially aligned with the elongated ribs of an adjacent disc, when the discs are stacked on top of each other, such as stacked onto a distributor.

As an example, all spacing members and/or all elongated ribs of a disc may be displaced compared to the spacing members and/or the elongated ribs of an adjacent disc.

A stack in which the spacing members are displaced, i.e. in which the spacing members are not axially aligned on top of each other, is advantageous in that it may provide better support for thin discs, i.e. the thin discs in a stack have more points of support compared to if the discs are arranged so that the spacing members are aligned on top of each other in the disc stack. Thus, a stack in which the spacing members are displaced facilitates the use of thin discs in the stack.

Furthermore, a stack in which the spacing members are displaced may be advantageous in that it allows for easy manufacturing or assembly of the disc stack, i.e. the spacing members allows even interspaces between discs in the stack even if the spacing members are not axially aligned. In other words, in a disc stack, the spacing members have the ability to bear the large compression forces in a compressed stack without having to be aligned on top of each other. This is thus different from the conventional idea of forming a disc stack, in which conventional elongated spacing members on the discs are axially aligned on top of each other in mutually adjacent separation discs throughout the stack of separation discs, or in other words, the spacing elements are in the prior art arranged in axially straight lines throughout the stack of separation discs, in order to bear all the compression forces in the compressed stack.

However, the discs in the stack may also be arranged so that the spacing members and the elongated ribs are axially aligned.

Thus, in embodiments of the second aspect of the invention, the discs having spacing members are arranged so that a majority or all of the spacing members of a disc are axially aligned with the spacing members of an adjacent disc.

In embodiments of the second aspect of the invention, the discs having spacing members and elongated ribs according to the first aspect above are arranged so that the elongated ribs a disc are axially aligned with the elongated ribs of an adjacent disc.

In embodiments of the second aspect of the invention, the discs having spacing members and elongated ribs according to the first aspect above are arranged so that the elongated ribs a disc are axially aligned with the elongated ribs of an adjacent disc whereas a majority or all of the spacing members of a disc are displaced compared to the spacing members of an adjacent disc.

In embodiments of the second aspect of the invention, the stack comprises more than 100 separation discs, such as more than 150, such as more than 200, such as more than 250, such as more than 300 separation discs.

In embodiments of the second aspect of the invention, a majority of all discs in the stack are the discs having the spacing members and elongated ribs according to the first aspect above.

As an example, the stack may comprise more than 100 separation discs and more than 90% of those separation discs may be separation discs having spacing members and elongated ribs according to the first aspect above.

As an example, the stack may comprise more than 150 separation discs and more than 90% of those separation discs, such as all separation discs, may be separation discs having spacing members and elongated ribs according to the first aspect above.

As an example, the stack may comprise more than 200 separation discs and more than 90% of those separation discs, such as all separation discs, may be separation discs having spacing members and elongated ribs according to the first aspect above.

As an example, the stack may comprise more than 250 separation discs and more than 90% of those separation discs, such as all separation discs, may be separation discs having spacing members and elongated ribs according to the first aspect above.

As an example, the stack may comprise more than 300 separation discs and more than 90% of those separation discs, such as all separation discs, may be separation discs having spacing members and elongated ribs according to the first aspect above.

The separation discs having spacing members and elongated ribs according to the first aspect above in the disc stacks as exemplified above may have a diameter that is more than 300 mm and comprise more than 300 spot-formed spacing members, such as more than 1000 spot-formed spacing members, such as more than 1300 spot-formed spacing members, or they may have a diameter that is more than 350 mm and comprise more than 500 spot-formed spacing members, such as more than 1400 spot-formed spacing members, such as more than 1800 spot-formed spacing members, or they may have a diameter that is more than 400 mm and comprise more than 600 spot-formed spacing members, such as more than 1700 spot-formed spacing members, such as more than 2200 spot-formed spacing members, or they may have a diameter that is more than 450 mm and comprise more than 700 spot-formed spacing members, such as more than 1900 spot-formed spacing members, such as more than 2800 spot-formed spacing members, or they may have a diameter that is more than 500 mm and comprise more than 900 spot-formed spacing members, such as more than 2700 spot-formed spacing members, such as more than 3600 spot-formed spacing members, or they may have a diameter that is more than 530 mm and comprise more than 1000 spot-formed spacing members, such as more than 3000 spot-formed spacing members, such as more than 4000 spot-formed spacing members Consequently, the stack may comprise more than 300 separation discs having a diameter that is more than 500 mm and more than 90% of those separation discs, such as all separation discs, may be separation discs having spacing members and elongated ribs according to the first aspect above and comprise more than 3000 spot-formed spacing members, such as more than 4000 spot-formed spacing members.

In embodiments of the second aspect of the invention, the stack of separation discs is arranged so that the spot-formed spacing members are the major load-bearing elements in the stack of separation discs.

This means that a majority of the compression forces are held by spot-formed spacing members in the disc stack.

In embodiments of the second aspect of the invention, the plurality of discs having spacing members and elongated ribs according to the first aspect above is free of discs having spacing members other than the spot-formed spacing members for creating interspaces between the discs in the stack.

Thus, the plurality of discs having spacing members and elongated ribs according to the first aspect above, and also the whole disc stack, may comprise solely spot-formed spacing members as load-bearing elements.

In embodiments of the second aspect of the invention, the stack of separation discs further comprises at least one axial rising channel formed by at least one through hole in the truncated surface or formed by at least one cut-out at the outer periphery of a plurality or all separation discs in the stack.

As discussed in relation to the first aspect above, such axial rising channels may facilitate feeding and distributing fluid mixture, such as a liquid, into the interspaces in the stack of separation discs.

As a third aspect of the invention, there is provided a centrifugal separator for separation of at least two components of a fluid mixture which are of different densities, which centrifugal separator comprises

- a stationary frame,
- a spindle rotatably supported by the frame,
- a centrifuge rotor mounted to a first end of the spindle to rotate together with the spindle around an axis (X) of rotation, wherein the centrifuge rotor comprises a rotor casing enclosing a separation space in which a stack of separation discs is arranged to rotate coaxially with the centrifuge rotor,
- a separator inlet extending into the separation space for supply of the fluid mixture to be separated,
- a first separator outlet for discharging a first separated phase from the separation space,
- a second separator outlet for discharging a second separated phase from the separation space;
- wherein the stack of separation discs is as according to the second aspect of the invention discussed above.

The terms and definitions used in relation to the third aspect are the same as discussed in relation to the other aspects above.

The centrifugal separator is for separation of a fluid mixture, such as a gas mixture or a liquid mixture. The stationary frame of the centrifugal separator is a non-rotating part, and the spindle and is supported by the frame by at least one bearing device, such as by at least one ball-bearing.

The centrifugal separator may further comprise a drive member arranged for rotating the spindle and the centrifuge rotor mounted on the spindle. Such a drive member for rotating the spindle and centrifuge rotor may comprise an electrical motor having a rotor and a stator. The rotor may be provided on or fixed to the spindle so that it transmits driving torque to the spindle and hence to the centrifuge rotor during operation.

Alternatively, the drive member may be provided beside the spindle and rotate the spindle and centrifuge rotor by a suitable transmission, such as a belt or a gear transmission.

The centrifuge rotor is adjoined to a first end of the spindle and is thus mounted to rotate with the spindle. During operation, the spindle thus forms a rotating shaft. The first end of the spindle may be an upper end of the spindle. The spindle is thus rotatable around the axis of rotation (X).

The spindle and centrifuge rotor may be arranged to rotate at a speed of above 3000 rpm, such as above 3600 rpm.

The centrifuge rotor further encloses a separation space in which the separation of the fluid mixture takes place. Thus, the centrifuge rotor forms a rotor casing for the separation space. The separation space comprises a stack of separation discs as discussed in relation to the second aspect of the invention above and the stack is arranged centrally around the axis of rotation. Such separation discs thus form surface enlarging inserts in the separation space.

The separator inlet for fluid mixture, i.e. feed, that is to be separated may be a stationary pipe arranged for supplying the feed to the separation space. The inlet may also be provided within a rotating shaft, such as within the spindle.

The first separator outlet for discharging a first separated phase from the separation space may be a first liquid outlet.

The second separator outlet for discharging a second separated phase from the separation space may be a second liquid outlet. Thus, the separator may comprise two liquid outlets, wherein the second liquid outlet is arranged at a larger radius from the rotational axis as compared to the first liquid outlet. Thus, liquids of different densities may be separated and be discharged via such first and second liquid outlets, respectively. The separated liquid of lowest density may be discharged via the first separator outlet whereas the separated liquid phase of higher density may be discharged via the second separator outlet, respectively.

During operation, a sludge phase, i.e. mixed solid and liquid particles forming a heavy phase, may be collected in an outer peripheral part of the separation space. Therefore, the second separator outlet for discharging a second separated phase from the separation space may comprise outlets for discharging such a sludge phase from the periphery of the separation space. The outlets may be in the form of a plurality of peripheral ports extending from the separation space through the centrifuge rotor to the rotor space between the centrifuge rotor and the stationary frame. The peripheral ports may be arranged to be opened intermittently, during a short period of time in the order of milliseconds, to enable discharge of a sludge phase from the separation space to the rotor space. The peripheral ports may alternatively be in the form of nozzles that are constantly open during operation to allow a constant discharge of sludge.

However, the second separator outlet for discharging a second separated phase from the separation space may be a second liquid outlet, and the centrifugal separator may further comprise a third separator outlet for discharging a third separated phase from the separation space.

Such a third separator outlet comprise outlets for discharging a sludge phase from the periphery of the separation space, as discussed above, and may be in the form of a plurality of peripheral ports arranged to be opened intermittently or in the form of nozzles that are constantly open during operation to allow a constant discharge of sludge.

The centrifugal separator according to the third aspect of the invention is advantageous in that it allows for operation with high flow rates of feed, i.e. mixture to be separated.

In certain separator applications, the separation fluid during the separation process is kept under special hygienic conditions and/or without any air entrainment and high shear forces, such as when the separated product is sensitive to such influence. Examples of that kind are separation of dairy products, beer and in biotechnology applications. For such applications, so called hermetic separators have been developed, in which the separator bowl or centrifuge rotor is completely filled with liquid during operation. This means that no air or free liquid surfaces is meant to be present in the rotor.

In embodiments of the first aspect of the invention, at least one of the separator inlet, first separator outlet or second separator outlet is mechanically hermetically sealed.

Hermetic seals reduce the risk of oxygen or air getting into the separation space and contact the liquid to be separated.

Accordingly, in embodiments of the third aspect of the invention, the centrifugal separator is for separating dairy products, such as separating milk into cream and skimmed milk In embodiments of the third aspect of the invention, the stack of separation discs comprises at least 200, such as at least 300 separation discs having a diameter of at least 400 mm, and wherein the plurality of discs having spot-formed spacing members comprise at least 2000 spot-formed spacing members on each disc.

As an example, the stack of separation discs may comprise more than 300 separation discs and more than 90% of those separation discs, such as all separation discs, may have a diameter of at least 500 mm and may be separation discs having spot-formed spacing members comprising at least 4000 spot-formed spacing members on each disc.

BRIEF DESCRIPTION OF THE DRAWINGS

FIG. 1*a* is a perspective view, FIG. 1*b* is a view from the bottom, i.e. showing the inner surface of the separation disc, and FIG. 1*c* is a close-up view of the outer periphery of the inner surface.

FIG. 8*a* is a perspective view, FIG. 8*b* is a radial section and FIG. 8*c* is a close up-view of the inner surface.

FIG. 9*a* is a radial section and FIG. 9*b* is a close up-view of the inner surface.

DETAILED DESCRIPTION

Examples of separation discs, stacks of separation discs as well as a centrifugal separator according to the present disclosure will be further illustrated by the following description with reference to the accompanying drawings.

Figure 1A:
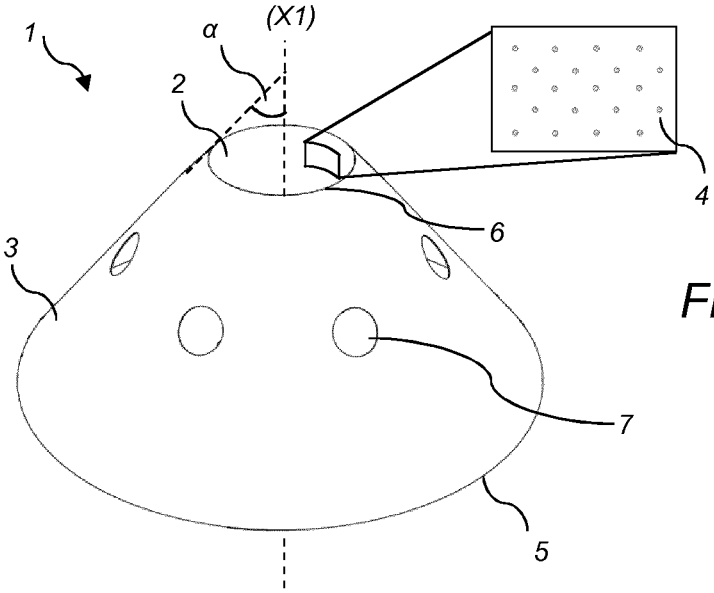
FIG. 1*a-c* shows an embodiment of a separation disc.
Figure 1B:
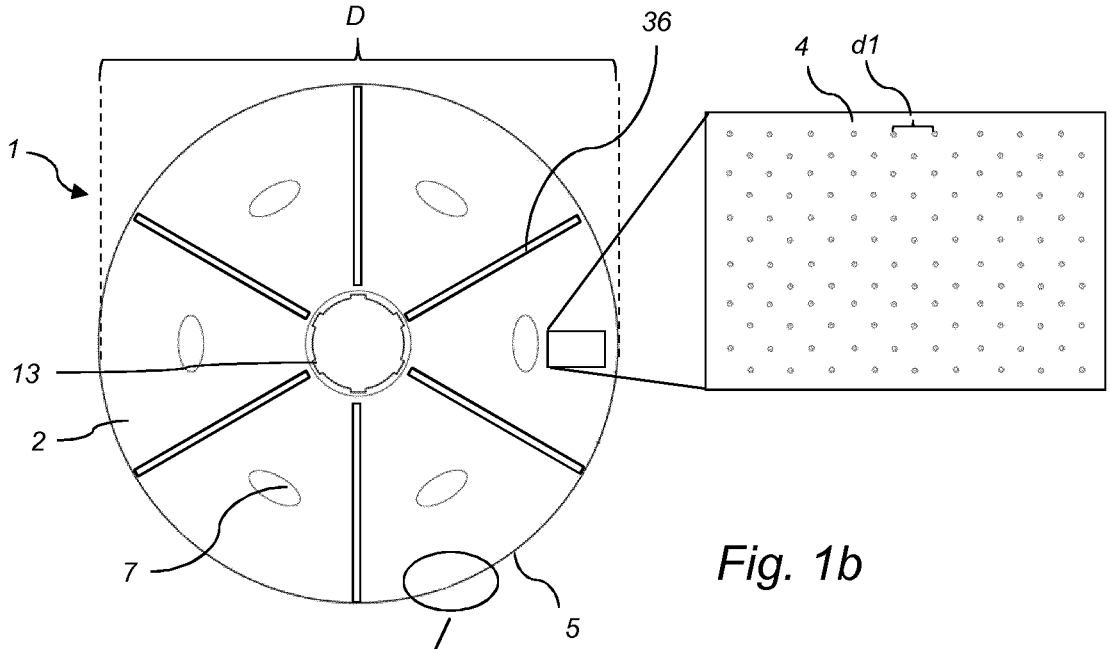
Figure 1C:
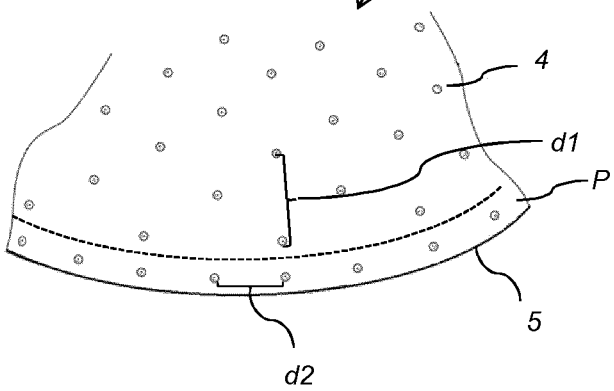

FIGS. 1*a-c* shows a schematic drawing of an embodiment of a separation disc. FIG. 1*a* is a perspective view of a separation disc 1 according to an embodiment of the present disclosure. The separation disc 1 has a truncated conical shape, i.e. a frusto-conical shape, along conical axis X1. Axis X1 is thus the direction of the axis passing through the apex of the corresponding conical shape. The conical surface forms cone angle $\alpha$ with conical axis X1. The separation disc has an inner surface 2 and an outer surface 3, extending radially from an inner periphery 6 to an outer periphery 5. In this embodiment, the separation disc is also provided with a number of through holes 7, located at a radial distance from both the inner and outer peripheries. When forming a stack with other separation discs of the same kind, through holes 7 may thus form axial distribution channels for e.g. liquid mixture to be separated that facilitates even distribution of the liquid mixture throughout a stack of separation discs. The separation disc further comprises a plurality of spot-formed spacing members 4 extending above the inner surface of the separation disc 1. These spacing members 4 provide interspaces between mutually adjacent separation discs in a stack of separation discs. Examples of spot-formed spacing members are shown in more detail in FIGS. 4*a*-4*f*. As seen in FIG. 1*a*, only the inner surface 2 is provided with spot-formed spacing members 4, whereas outer surface 3 is free of spot-formed spacing members 4 and also free of other spacing members. Inner surface 2 is also free of other spacing members than the spot-formed spacing members 4. Thus, in a stack of separation discs 1 of the same kind, spot-formed spacing members 4 are the only spacing members, i.e. the only members that form the interspaces and axial distances between discs in the stack. The spot-formed spacing members are thus the only load-bearing element on the disc 1 when discs are axially stacked on top of each other. This is thus a difference from a conventional separation disc, in which a few elongated, radially extending spacing members on each disc form the interspaces and bear the compression forces in a disc stack.

However, as an alternative, it is to be understood that outer surface 3 could be provided with the spot-formed spacing members 4 whereas inner surface 2 could be free of spot-formed spacing members 4 and also free of other spacing members.

FIG. 1*b* shows the inner surface 2 of the separation disc 1. The spot-formed spacing members 4 extends from a base at the inner surface 2 that has a width that is less than 1.5 mm along the inner surface 2 of the separation disc 1. Furthermore, the mutual distance d1 between the spot-formed spacing members 4 is about 10 mm, and the whole inner surface 2 comprises about 100 spacing members/$dm^2$. The inner surface 2 further comprises six elongated ribs that extend radially from the inner periphery out to the outer periphery of the separation disc. Thus, the inner periphery represents a first position and the outer periphery represents a second position at a radial distance that is larger than the radial distance of the first position. The elongated ribs 36 are lesser in height than the spot-formed spacing members and thus do not contribute in forming the interspaces in a stack of separation discs.

There are also a number of cut-outs 13 at the inner periphery 6 of the separation disc 1 in order to facilitate stacking on e.g. a distributor.

FIG. 1*c* shows a close-up view of the outer periphery 5 of the inner surface 2 of the separation disc 1. In this embodiment, the density of spot-formed spacing members 4 is higher at the outer periphery than on the rest of the disc. This is achieved by having more spot-formed spacing members arranged in an outer peripheral zone P, so that the distance d2 between the radially outermost spacing members 4 within the outer peripheral zone P is less than the distance d1 between spacing members 4 outside this zone. The peripheral zone P may for example extend 10 mm radially from the outer periphery 5. A higher density of spacing members at the outermost periphery is advantageous in that it decreases the risk for mutually adjacent discs in a disc stack touching each other at the outermost periphery where the compression and centrifugal forces are high. Mutually adjacent discs touching each other will block the interspace and thus lead to a decreased efficiency of the disc stack.

Figure 2A:
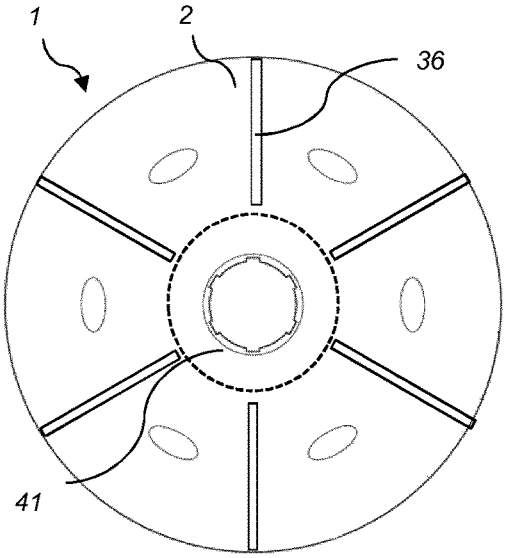
FIG. 2*a-d* shows further embodiments of separation discs having elongated ribs.
Figure 2B:
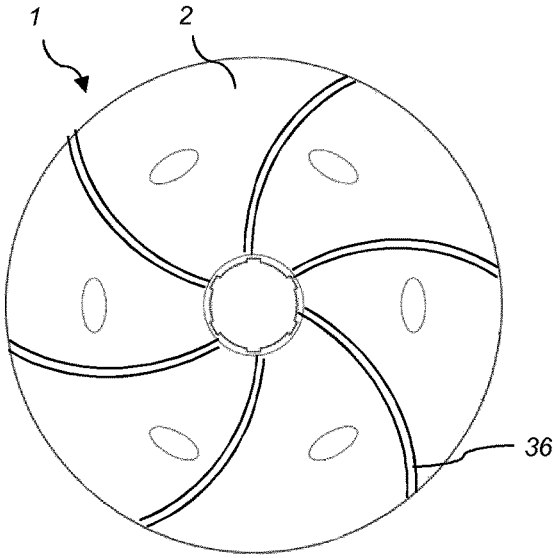
Figure 2C:
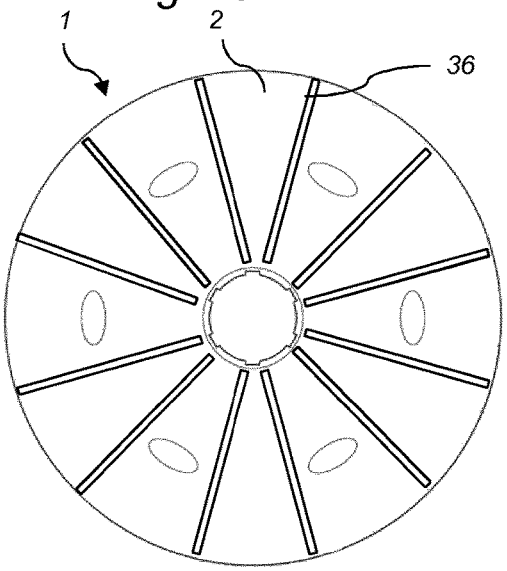
Figure 2D:
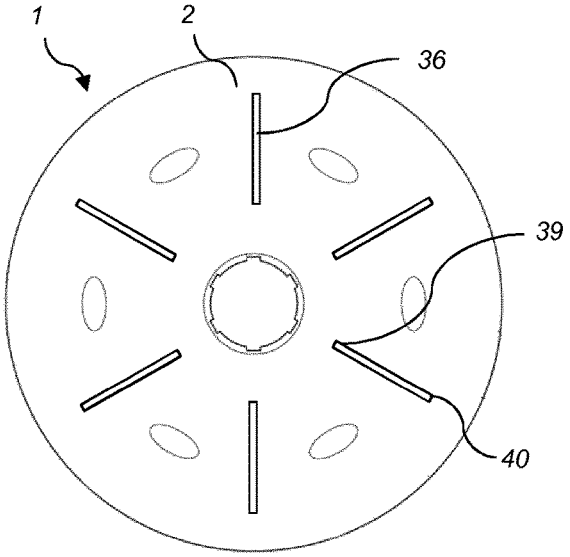

FIG. 2*a*-*d* show different variations of the disc as seen in FIG. 1*a*-*c*. In FIG. 2*a*, the elongated ribs are of lesser length and extend on the inner surface all the way to the outer periphery but start at a radial position so that a radial inner portion 41 of the separation disc 1 is free of elongated ribs. In FIG. 2*b*, the elongated ribs 36 are curved. FIG. 2*c* shows an example of a disc having 12 elongated ribs arranged on the inner surface, each extending straight in the radial direction. However, as discussed above, the ribs may be straight but extend in a direction that forms an angle to the radial direction. FIG. 2*d* shows an embodiment of a separation disc 1 having shorter ribs, i.e. ribs that extend a shorter distance in the radial direction, than the previous examples. The ribs 36 extend from a first position 39 being other than the inner periphery and at to a second position 40 that is radially inward compared to the outer periphery.

Figure 3A:
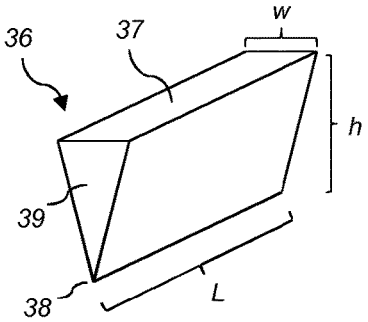
FIG. 3*a-c* show embodiments of different shapes of elongated ribs.
Figure 3B:
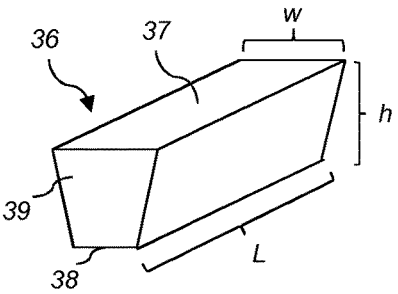
Figure 3C:
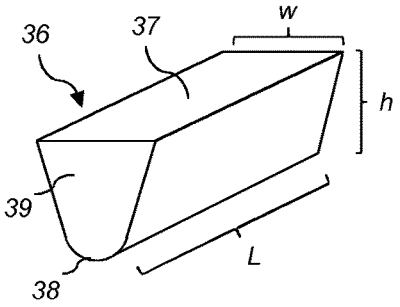

FIGS. 3*a*-*c* shows different examples on the shape of the ribs 36. The ribs 36 in FIGS. 3*a*-*c* are not drawn to scale, but merely represents a schematic drawing of the shape. The rib 36 of FIG. 3*a* extends a distance L along the surface of the separation disc. L may be about 50-250 mm. The rib 36 extends a height h from the surface and has further width w at the surface. The width w is thus the width at the base portion 37 of the rib 36. The width w may for example be less than 20 mm, such as about or less than 10 mm. The height h may for example be between 0.20-0.40 mm. The width w at the surface is wider than the width at the outermost portion 38 of the rib 36, i.e. at height h from the surface. Thus, the elongated rib tapers from the surface outwards to the outermost portion 38. In FIG. 3*a*, the cross-section perpendicular to the direction in which the rib 36 is extends is tip-shaped with a sharp tip. In FIG. 3*b*, the rib also tapers from the base portion 37 to the outermost portion 38, but the outermost portion is flat with a surface substantially parallel to the base portion 37, i.e. parallel to the surface of the disc. In FIG. 3*c*, the rib 36 also tapers from the surface but the cross-section perpendicular to the direction in which the rib 36 is extends is tip-shaped with a more smooth, rounded tip than the cross-section of the rib 36 of FIG. 3*a*.

Figure 4A:
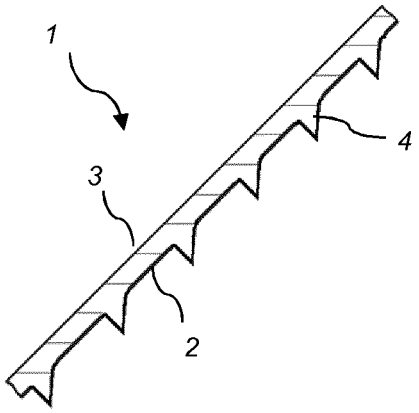
FIG. 4*a-f* shows embodiments of different tip-shaped and spot-formed spacing members.
Figure 4B:
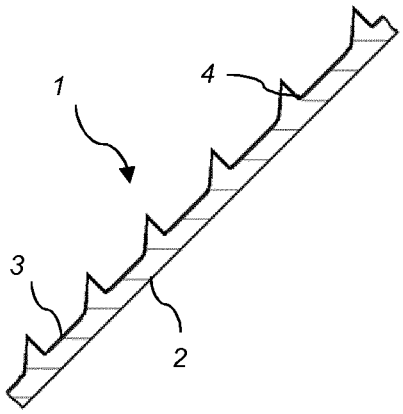

FIGS. 4*a*-*f* show embodiments of different types of spot-formed spacing members that may be used as spacing members on the separation disc of the present disclosure. FIG. 4*a* shows a section of a part of a separation disc 1 in which the spot-formed spacing members 4 are arranged in a line extending in the radial direction on the inner surface 2 of the disc 1. Outer surface 3 is free of any kind of spacing member. The spacing members 4 are integrally formed in the separation disc 1, i.e. formed in one piece with the material of the separation disc itself. The spacing members 4 are tip-shaped and taper from the surface to a tip that extends a certain distance or height from the inner surface 2. FIG. 4*b* shows a similar section as the disc of FIG. 4*a*, but in this example the tip-shaped and spot-formed spacing members are only provided on the outer surface 3, whereas inner surface 2 is free of spot-formed spacing members.

Figure 4C:
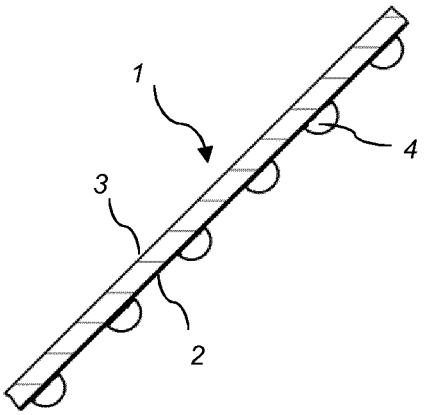
Figure 4D:
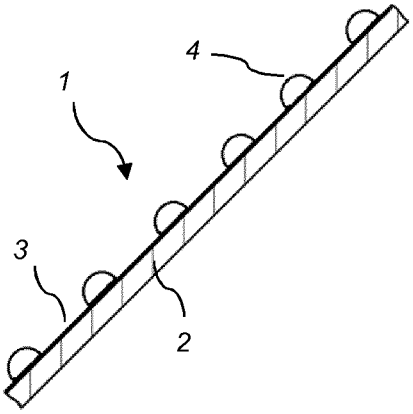

FIG. 4*c* also shows a section of a part of another example of a separation disc 1 in which the spot-formed spacing members 4 are arranged in a line extending in the radial direction on the inner surface 2 of the disc 1 whereas outer surface 3 is free of any kind of spacing member. The spacing members 4 are in this example shaped as half-spheres that protrude from the inner surface 2. FIG. 4*d* shows a similar section as the disc of FIG. 4*c*, but in this example the half-spherical and spot-formed spacing members are only provided on the outer surface 3, whereas inner surface 2 is free of spot-formed spacing members.

Figure 4E:
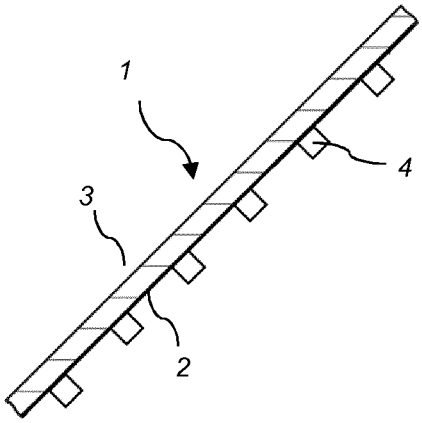
Figure 4F:
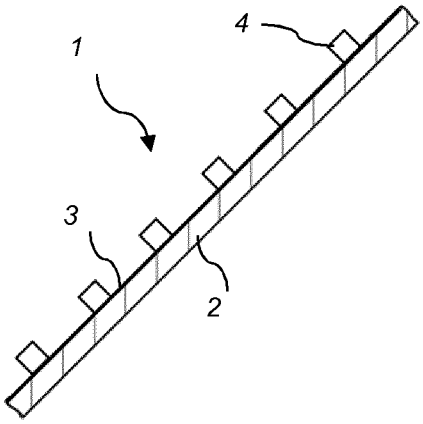

FIG. 4*e* also shows a section of a part of another example of a separation disc 1 in which the spot-formed spacing members 4 are arranged in a line extending in the radial direction on the inner surface 2 of the disc 1 whereas outer surface 3 is free of any kind of spacing member. The spacing members 4 are in this example shaped as cylinders that protrude from the inner surface 2. FIG. 4*f* shows a similar section as the disc of FIG. 4*e*, but in this example the cylindrical and spot-formed spacing members are only provided on the outer surface 3, whereas inner surface 2 is free of spot-formed spacing members.

Figure 5:
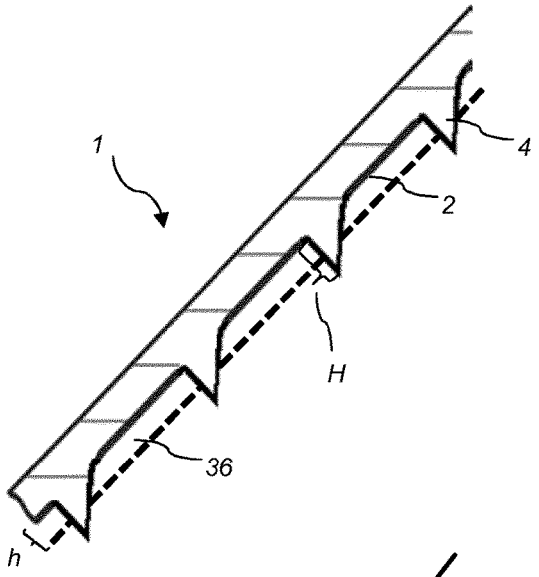
FIG. 5 shows the relation between spacing members and elongated ribs.

FIG. 5 shows the relation in height between an elongated rib 36 and the spacing members 4. The disc as seen in FIG. 5 is a similar to the disc in FIG. 4*a*, having spot-formed and tip-shaped spacing members 4 that extend a height H from the inner surface 2. Also drawn in FIG. 5 is the size of an elongated rib 36 that extends height h from the surface. The relation between h and H is that H is larger than h and h/H>0.7, i.e. the elongated ribs 36 do not bear any weight in a compressed stack of separation discs 1.

Figure 6A:
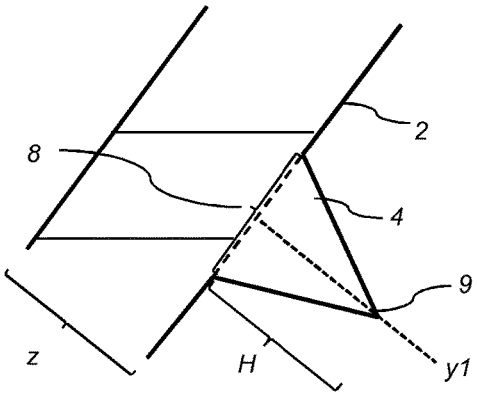
FIG. 6*a-d* shows different spot-formed and tip-shaped spacing members.
Figure 6B:
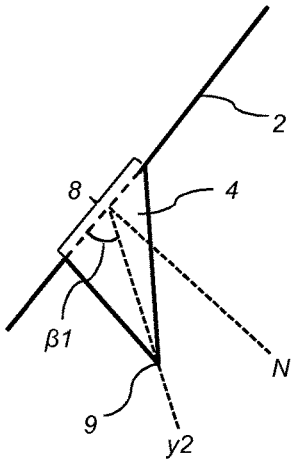

FIGS. 6*a-d* show embodiments of different tip-shaped and spot-formed spacing members that may be used on the separation disc of the present disclosure, FIG. 6*a* shows a close-up view of an embodiment of a tip-shaped spacing member 4. The tip-shaped spacing member 4 extends from a base 8 on the inner surface 2. This base 8 extends to a width that is less than 1.5 mm along the inner surface 2 of the separation disc 1. The tip-shaped spacing member tapers from the base 8 to a tip 9 located a distance H from the base. Thus, the height of the tip-shaped spacing member is distance H, which in this case is between 0.15 and 0.30 mm, whereas the thickness of the separation disc, as illustrated by distance z in FIG. 6*b*, is between 0.30 and 0.40 mm. In the example of FIG. 6*a*, the tip-shaped spacing member 4 extends from base 8 in the direction y1 that is substantially perpendicular to the inner surface 2. Direction y1 is thus parallel to the normal N of the inner surface 2.

FIG. 6*b* shows an example of a tip-shaped spacing member 4 that extends from the surface of the separation disc in a direction that forms an angle with the surface which is less than 90 degrees. The spacing member 4 of FIG. 6*b* is the same as the spacing member shown in FIG. 6*a*, but with the difference that it extends in a direction y2 that forms an angle with the normal N of the inner surface. In this case, the tip-shaped spacing member 4 extends in a direction y2 that forms angle β1 with the inner surface 2, and angle β1 is less than 90 degrees. Thus, tip 9 extends from base 8 in direction y2 that forms an angle with the surface that is about 60-70°.

Figure 6C:
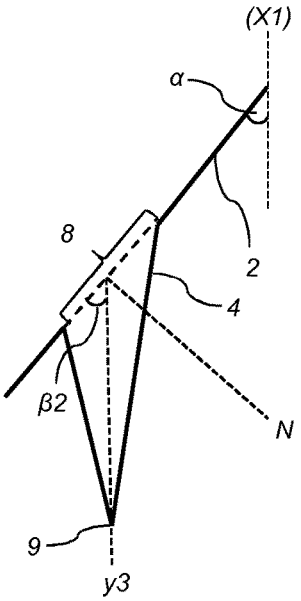

FIG. 6*c* shows a further example of a tip-shaped spacing member 4 that extends from the surface of the separation disc in a direction that forms an angle with the surface which is less than 90 degrees. The spacing member 4 of FIG. 6*c* is the same as the spacing member shown in FIG. 6*b*, but with the difference that it extends in a direction y3 that forms an angle β2 with the inner surface that is less than angle β1 in FIG. 6*b*. In this example, angle β2 is substantially the same as the alpha angle α of the separation disc 1, i.e. half of the opening angle of the corresponding conical shape of the separation disc. Angle α is thus the angle of the conical portion with conical axis X1 of the separation disc 1. Angle α may be about 35°. In other words, the tip-shaped spacing member 4 extends from the inner surface 2 of the separation disc 1 in substantially the axial direction of the truncated conical shape of the separation disc 1. Thus, in a formed stack of separation discs, a spot-formed spacing member extending substantially axially may better adhere to an adjacent disc in the stack, thereby further decreasing the risk for unevenly sized interspaces between the discs as the stack is compressed.

It is to be understood that a majority or all spot-formed spacing members 4 on a separation disc may extend in the same direction, i.e. a majority or all spot-formed spacing members 4 on a separation disc may extend in a direction that is substantially perpendicular to the surface or a majority or all spot-formed and tip-shaped spacing members 4 on a separation disc may extend in a direction that forms an angle with the surface, i.e. like the examples shown in FIGS. 6*b* and 6*c*.

Figure 6D:
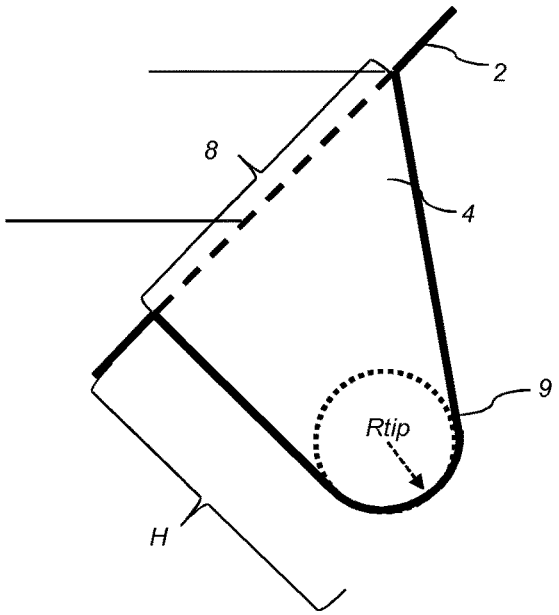

Furthermore, the tip 9 of a tip-shaped and spot-formed spacing member has a tip radius $R_{tip}$, and is further shown in more detail in FIG. 6*d*. This tip radius $R_{tip}$ is small in order to get as sharp tip as possible. As an example, tip radius $R_{tip}$ may be less than the height H to which the spot-formed spacing member 4 extend from the inner surface 2. Further, tip radius $R_{tip}$ may be less than half the height H, such as less than a tenth of the height H.

Figure 7:
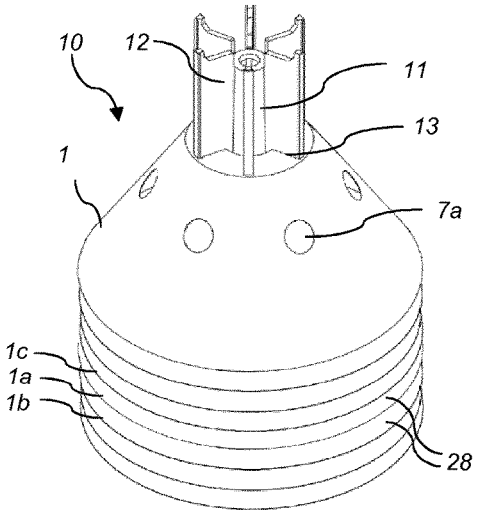
FIG. 7 shows an embodiment of a disc stack.

FIG. 7 shows an embodiment of a disc stack 10 comprising separation discs 1 according to the present disclosure. The disc stack 10 comprises separation discs 1 provided on a distributor 11. For clarity, FIG. 7 only shows a few separation discs 1, but it is to be understood that the disc stack 10 may comprise more than 200 separation discs 1, such as more than 300 separation discs. Due to the spacing members, interspaces 28 are formed between stacked separation discs 1, i.e. interspace 28 is formed between a separation disc 1*a* and the adjacent separation discs 1*b* and 1*c* located below and above separation disc 1*a*, respectively. Through holes in the separation discs form axial rising channels 7*a* extending throughout the stack. Furthermore, the disc stack 10 may comprise a top disc (not shown), i.e. a disc arranged at the very top of the stack that is not provided with any through holes. Such a top disc is known in the art. The top disc may have a diameter that is larger than the other separation discs 1 in the disc stack in order to aid in guiding a separated phase out of a centrifugal separator. A top disc may further have a larger thickness as compared to the rest of the separation discs 1 of the disc stack 10. The separation discs 1 may be provided on the distributor 11 using cut outs 13 at the inner periphery 5 of the separation discs 10 that are fitted in corresponding wings 12 of the distributor.

Figure 8A:
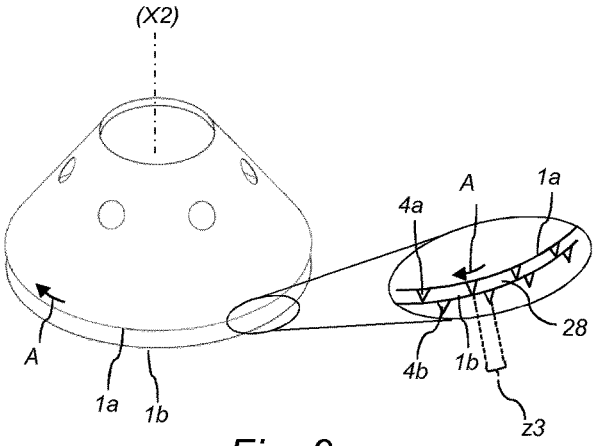
FIG. 8*a-c* shows an embodiment of a disc stack in which the spot-formed spacing members of a separation disc are displaced in relation to the spot-formed spacing members of an adjacent disc.
Figure 8B:
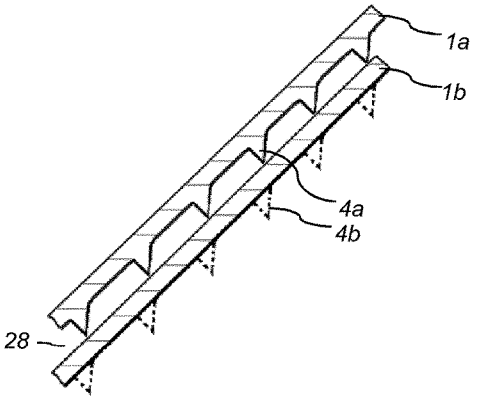
Figure 8C:
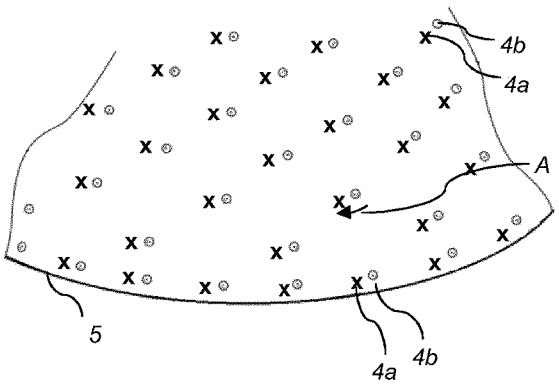

FIGS. 8*a-c* shows an embodiment in which the separation discs 1 comprises spot formed spacing members. The separation discs 1 are axially arranged in the stack 10 so that a majority of the spot-formed spacing members 4*a* of a disc 1*a* are displaced compared to the spot-formed and spacing members 4*b* of an adjacent disc 1*b*. In this embodiment, this is performed by a small rotation in the circumferential direction of disc 1*a* as compared to adjacent disc 1*b*, as illustrated by arrow "A" in FIGS. 8*a-c*. Thus, as seen in FIG. 8*a*, adjacent separation discs 1*a* and 1*b* are axially aligned along rotational axis X2, which is the same direction as conical axis X1 as seen in FIGS. 1 and 2, but due to the arrangement of the spot-formed spacing members, a spot-formed spacing member 4*a* of separation disc 1*a* is not axially aligned over corresponding spot-formed spacing member 4*b* of separation disc 1*b*. As an example, the discs 1*a* and 1*b* are arranged so that a spot-formed spacing member 4*a* of disc 1*a* is displaced a circumferential distance z3 in relation to corresponding spot-formed spacing member 4*b* of disc 1*b*. Distance z3 may be about half the distance of the mutual distance between spot-formed spacing members on a disc, such as between 2-10 mm.

In other words, the separation discs of the disc stack 1 are arranged so that a spot-formed and spacing member 4*a* of a separation disc 1*a* does not abut adjacent disc 1*b* at a position where the adjacent disc 1*b* has spot-formed spacing member 4*b*. This is also illustrated in FIG. 8*b*, which shows a section of adjacent discs 1*a* and 1*b*. The spot-formed spacing members 4*a* of disc 1*a* and the spot-formed spacing members 4*b* of disc 1*b* may be provided at the same radial distance, but are shifted in the circumferential direction.

Furthermore, FIG. 8*c* shows a close-up view of the outer periphery 5 of disc 1*b*. The spot-formed members 4*a* of adjacent disc 1*a* abut separation disc 1*b* at positions indicated by crosses in FIG. 8*c*, which are positions that are shifted in the circumferential direction as compared to the positions of the spot-formed spacing members 4*b*, as illustrated by arrow "A".

Figure 9A:
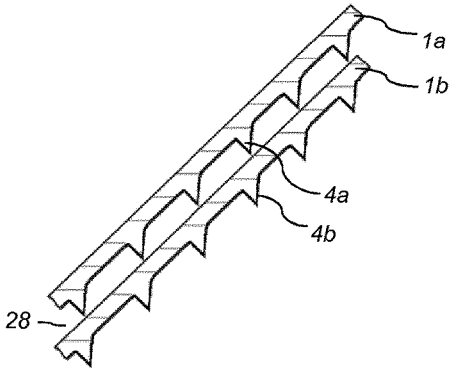
FIGS. 9*a* and *b* shows an embodiment of a disc stack in which the spot-formed spacing members of a separation disc are axially aligned with the spot-formed spacing members of an adjacent disc.
Figure 9B:
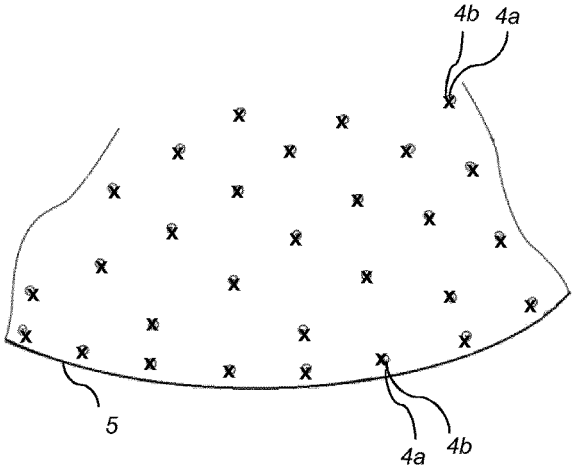

However, the separation discs 1 of the disc stack 10 may be provided on the distributor 11 so that a majority of the spacing members of a disc are axially aligned with the 8 spacing members of an adjacent disc. This is illustrated in FIGS. 9*a* and 9*b*, in which adjacent separation discs 1*a* and 1*b* are arranged so that spot-formed spacing members 4*a* of disc 1*a* are aligned with the spot-formed spacing members 4*b* of disc 1*b*. FIG. 9*a* shows a section of adjacent discs 1*a* and 1*b* in which spacing members 4*a* and 4*b* are aligned, whereas FIG. 9*b* shows a close-up view of the outer periphery 5 of disc 1*b*. In contrast to the embodiment illustrated in FIG. 8*c*, the spot-formed spacing members 4*a* of adjacent disc 1*a* actually abut separation disc 1*b* at the positions of the spot-formed spacing members 4*b* of discs 1*b*, as indicated by the crosses in FIG. 9*b*.

Figure 10:
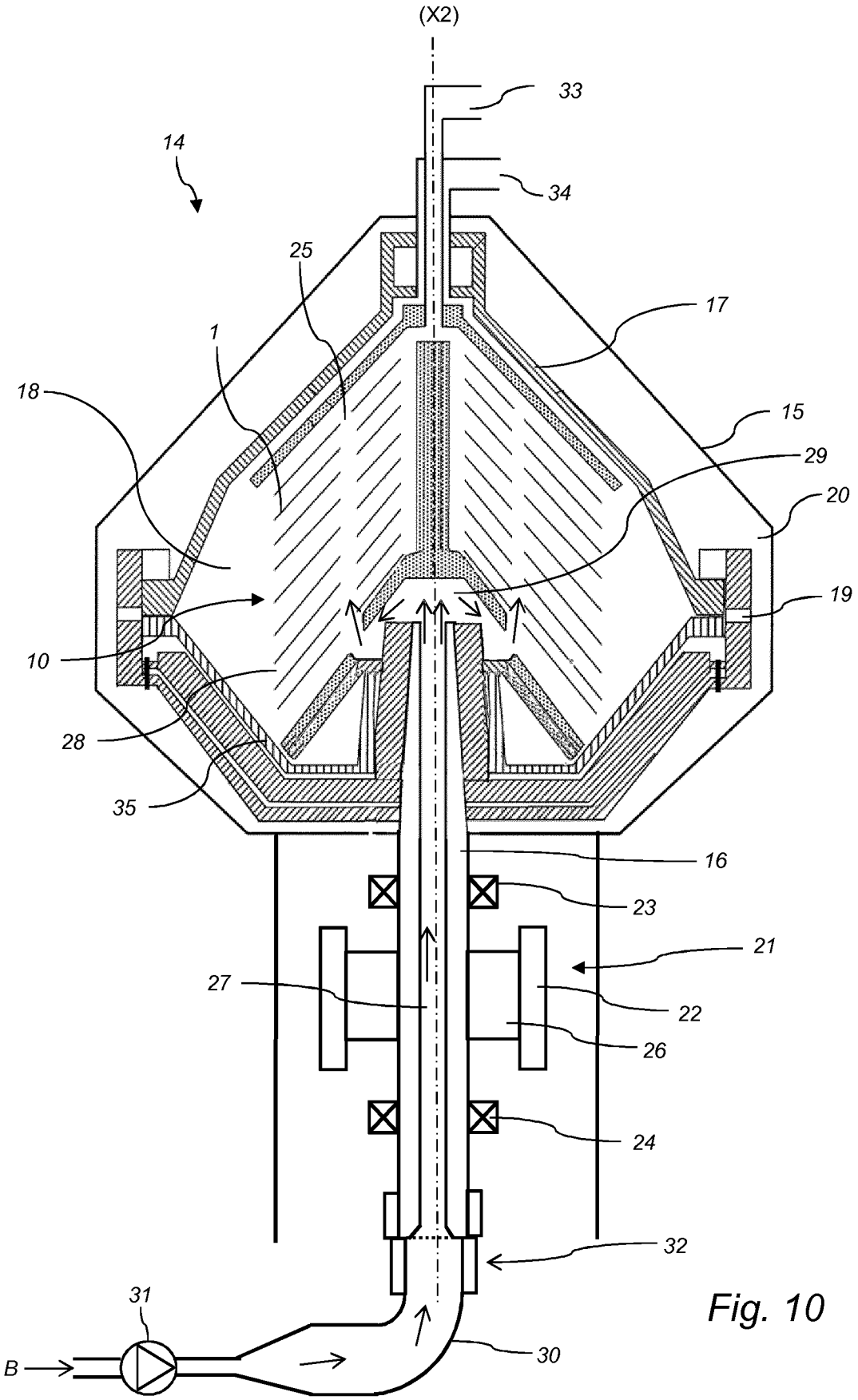
FIG. 10 shows a section of a centrifugal separator.

FIG. 10 shows a schematic example of a centrifugal separator 14 according to an embodiment of the present disclosure, arranged to separate a liquid mixture into at least two phases. Further, it is to be understood that FIG. 10 is a schematic drawing and is thus not drawn into scale.

The centrifugal separator 14 comprises a rotating part arranged for rotation about an axis of rotation (X2) and comprises rotor 17 and spindle 16. The spindle 16 is supported in a stationary frame 15 of the centrifugal separator 14 in a bottom bearing 24 and a top bearing 23. The stationary frame 15 surrounds rotor 17.

The rotor 17 forms within itself a separation chamber 18 in which centrifugal separation of e.g. a liquid mixture to takes place during operation. The separation chamber 18 may also be referred to as a separation space 18.

The separation chamber 18 is provided with a stack 10 of frusto-conical separation discs 1 in order to achieve effective separation of the fluid to be separated in the interspaces 28 between the discs 1. The stack 10 of truncated conical separation discs 1 are examples of surface-enlarging inserts. These discs 1 are fitted centrally and coaxially with the rotor 17 and also comprise through holes which form axial channels 25 for axial flow of liquid when the separation discs 1 are fitted in the centrifugal separator 14. The separation discs 1 are as discussed in the examples above and comprises both spot-formed spacing members and elongated ribs integrally formed on the inner surface of each disc.

In FIG. 10, only a few discs 1 are illustrated in the stack 10, and the stack comprises in this case more than 200 separation discs having spot-formed spacing members.

The rotor 17 has extending from it a liquid light phase outlet 33 for a lower density component separated from the liquid mixture, and a liquid heavy phase outlet 34 for a higher density component, or heavy phase, separated from the liquid mixture. The outlets 33 and 34 extend through the frame 15. The outlets 33, 34 may also be referred to as separator outlets 33, 34. In certain applications, the separator 14 only contains a single liquid outlet, such as only liquid outlet 33. This depends on the liquid material that is to be processed. The rotor 15 is further provided with a third outlet for discharge of sludge that has accumulated at the periphery of the separation chamber 18. The sludge outlet is in the form of a plurality of peripheral ports 19 that extend from the separation chamber 18 through the rotor casing to a surrounding space 20 outside the centrifuge rotor 17. The peripheral ports 19 may be intermittently openable during a short time period, e.g. in the order of milliseconds, and permit total or partial discharge of sludge from the separation space, using a conventional intermittent discharge system as known in the art.

The centrifugal separator 1 is further provided with a drive motor 21. This motor 21 may for example comprise a stationary element 22 and a rotatable element 26, which rotatable element surrounds and is connected to the spindle 16 such that it transmits driving torque to the spindle 16 and hence to the rotor 17 during operation. The drive motor 21 may be an electric motor. Furthermore, the drive motor 21 may be connected to the spindle 16 by transmission means. The transmission means may be in the form of a worm gear which comprises a pinion and an element connected to the spindle 16 in order to receive driving torque. The transmission means may alternatively take the form of a propeller shaft, drive belts or the like, and the drive motor may alternatively be connected directly to the spindle.

A central duct 27 extends through the spindle 16, which takes the form of a hollow, tubular member. The central duct 27 forms in this embodiment an inlet duct for supplying the liquid mixture for centrifugal separation to the separation space 18 via the inlet 29 of the rotor 17. The inlet duct may also be referred to as a separator inlet. Introducing the liquid material from the bottom provides a gentle acceleration of the liquid material. The spindle 16 is further connected to a stationary inlet pipe 30 at the bottom end of the spindle 16 such that liquid material to be separated may be transported to the central duct 27 by transporting means.

A first mechanical hermetic seal 32 is arranged at the bottom end of the spindle 16 to seal the hollow spindle 16 to the stationary inlet pipe 30. The hermetic seal 32 is an annular seal that surrounds the bottom end of the spindle 16 and the stationary pipe 30. Further, also the liquid light phase outlet 33 and the liquid heavy phase outlet 34 may be hermetically mechanically sealed. As an alternative, centripetal pumps, such as paring discs, may be arranged at outlets 33 and 34 to aid in transporting separated phases out from the separator.

During operation of the separator in FIG. 10, the rotor 17 is caused to rotate by torque transmitted from the drive motor 21 to the spindle 16. Via the central duct 27 of the spindle 16, liquid material to be separated, such as milk, is brought into the disc stack 10 via inlet 29 and axial rising channels 25. In the hermetic type of inlet 29, the acceleration of the liquid material is initiated at a small radius and is gradually increased while the liquid leaves the inlet and enters the separation chamber 18 and disc stack 10. Further, as discussed above, the separator 14 may also have hermetic outlets and the separation chamber 18 may be intended to be completely filled with liquid during operation. In principle, this means that preferably no air or free liquid surfaces is meant to be present within the rotor 17. However, liquid may also be introduced when the rotor is already running at its operational speed. Liquid material may thus be continuously introduced into the rotor 17.

The path of the liquid material to be separated through the spindle 16 to the separation space 18 is illustrated by arrows "B" in FIG. 10.

Depending on the density, different phases in the liquid is separated in the interspaces 28 between the separation discs of the stack 10 fitted in the separation space 18. Heavier components in the liquid move radially outwards between the separation discs, whereas the phase of lowest density moves radially inwards between the separation discs and is forced through outlet 33 arranged at the radial innermost level in the separator. The liquid of higher density is instead forced out through outlet 34 that is at a radial distance that is larger than the radial level of outlet 33. Thus, during separation, an interphase between the liquid of lower density and the liquid of higher density is formed in the separation space 18. Solids, or sludge, accumulate at the periphery of the separation space 18 and may be emptied intermittently from the separation space by opening of sludge outlets, i.e. the peripheral ports 19, whereupon sludge and a certain amount of liquid is discharged from the separation space by means of centrifugal force. The opening and closing of the peripheral ports 19 are controlled by means of a sliding bowl bottom 35 which is movable between an open and closed position along a direction parallel to the axis of rotation (X2).

In the embodiment of FIG. 10, the material to be separated is introduced via the central duct 27 of the spindle 16. However, the central duct 27 may also be used for withdrawing e.g. the liquid light phase and/or the liquid heavy phase. Thus, in embodiments, the central duct 27 comprises at least one additional duct, i.e. at least two ducts. In this way, the liquid mixture to be separated may be introduced to the rotor 17 via a central duct 27, and concurrently, the liquid light phase and/or the liquid heavy phase may be withdrawn through such an additional duct extending e.g. within the central duct 27 or surrounding central duct 27.

The invention is not limited to the embodiments disclosed but may be varied and modified within the scope of the claims set out below. The invention is not limited to the type of separator as shown in the Figures. The term "centrifugal separator" also comprises centrifugal separators with a substantially horizontally oriented axis of rotation and separator having a single liquid outlet.

The invention claimed is:

1. A separation disc for a centrifugal separator, said disc being adapted to be comprised in a stack of separation discs inside a centrifugal rotor for separating a fluid mixture, wherein the separation disc has a truncated conical shape with an inner surface and an outer surface and a plurality of spacing members extending a first height (H) from at least one of the inner surface and the outer surface, wherein said plurality of spacing members are for providing interspaces between mutually adjacent separation discs in the stack of separation discs, wherein said separation disc further comprises at least one elongated rib extending from the inner surface to a second height (h) that is less than the first height (H) to which said plurality of spacing members extend, wherein said at least one elongated rib extends from a first position on the inner surface to a second position on the inner surface, wherein the second position is at a radial distance that is larger than a radial distance of the first position, and wherein a relation between the second height of the elongated ribs (h) and the first height of the spacing members (H) is $h/H \geq 0.7$.

2. The separation disc according to claim 1, wherein the relation between the second height of the elongated ribs (h) and the first height of the spacing members (H) is $0.75 \leq h/H \leq 0.95$.

3. The separation disc according to claim 1, wherein said spacing members extend from the inner surface.

4. The separation disc according to claim 1, wherein said separation disc comprises at least four elongated ribs.

5. The separation disc according to claim 1, wherein said at least one elongated rib is straight and extends in the radial direction.

6. The separation disc according to claim 1, wherein said at least one elongated rib is curved.

7. The separation disc according to claim 1, wherein said at least one elongated rib extends a length that is more than 50% of the radial extension of the inner surface of the disc.

8. The separation disc according to claim 7, wherein said at least one elongated rib extends radially along substantially an entire radial extension of the inner surface of the disc.

9. The separation disc according to claim 1, wherein said at least one elongated rib has a width at the inner surface of the separation disc that is below 2 mm.

10. The separation disc according to claim 1, wherein said spacing members and said at least one elongated rib are integrally formed in one piece with the material of the separation disc.

11. The separation disc according to claim 1, wherein said at least one elongated rib is wider at the inner surface of the separation disc than at a portion at the second height (h) to which the elongated rib extends, when viewed in a cross-section that is perpendicular to the direction in which the elongated rib extends on the inner surface.

12. The separation disc according to claim 1, wherein said plurality of spacing members comprises a plurality of spot-formed spacing members.

13. The separation disc according to claim 12, wherein said spot-formed spacing members have a tip-shaped cross-section.

14. A stack of separation discs adapted to be comprised inside a centrifugal rotor for separating a liquid mixture, comprising axially aligned separation discs having a truncated conical shape with an inner surface and an outer surface, wherein said axially aligned separation discs comprise a plurality of discs having the spacing members and the at least one elongated rib according to claim 1 arranged so that said elongated rib on a separation disc is not in contact with an adjacent separation disc.

15. A centrifugal separator for separation of at least two components of a fluid mixture having different densities, said centrifugal separator comprising:

a stationary frame;

a spindle rotatably supported by the frame;

a centrifuge rotor mounted to a first end of the spindle to rotate together with the spindle around an axis (X) of rotation, wherein the centrifuge rotor comprises a rotor casing enclosing a separation space in which a stack of separation discs is arranged to rotate coaxially with the centrifuge rotor;

a separator inlet extending into said separation space for supply of the fluid mixture to be separated;

a first separator outlet for discharging a first separated phase from said separation space; and a second separator outlet for discharging a second separated phase from said separation space, wherein the stack of separation discs is the stack of separation discs according to claim 14.

16. The separation disc according to claim 2, wherein said spacing members extend from the inner surface.

17. The separation disc according to claim 2, wherein said separation disc comprises at least four elongated ribs.

18. The separation disc according to claim 1, wherein the relation between the second height of the elongated ribs (h) and the first height of the spacing members (H) is $0.80 \leq h/H \leq 0.90$.

19. The separation disc according to claim 1, wherein the elongated ribs are spaced from the spacing members in a circumferential direction.

20. The separation disc according to claim 1, wherein the second height of the elongated ribs is less than the first height of the spacing members.

* * * * *